US008314372B2

(12) United States Patent
Yoshihara et al.

(10) Patent No.: US 8,314,372 B2
(45) Date of Patent: Nov. 20, 2012

(54) INDUCTION HEATER WITH DIRECTIONAL CORES

(75) Inventors: Masaya Yoshihara, Fukuoka (JP); Yasuhiro Torigoe, Saga (JP); Fumihiro Tateno, Kumamoto (JP); Youichi Nakamura, Saga (JP)

(73) Assignee: Panasonic Corporation, Osaka (JP)

( * ) Notice: Subject to any disclaimer, the term of this patent is extended or adjusted under 35 U.S.C. 154(b) by 339 days.

(21) Appl. No.: 12/730,345

(22) Filed: Mar. 24, 2010

(65) Prior Publication Data

US 2011/0073587 A1 Mar. 31, 2011

(30) Foreign Application Priority Data

Sep. 28, 2009 (JP) ..... 2009-222235

(51) Int. Cl.
*H05B 6/14* (2006.01)

(52) U.S. Cl. ..... 219/619; 219/216; 219/670; 399/69; 399/328; 399/329; 399/330; 399/334; 430/124.1

(58) Field of Classification Search ..... 219/619; 399/330; 430/124.1
See application file for complete search history.

(56) References Cited

U.S. PATENT DOCUMENTS

| | | | | |
|---|---|---|---|---|
| 6,795,679 | B2 | 9/2004 | Shimizu et al. | |
| 2003/0147679 | A1 | 8/2003 | Shimizu et al. | |
| 2004/0226940 | A1 | 11/2004 | Monda et al. | |
| 2004/0238530 | A1 | 12/2004 | Nonaka et al. | |
| 2004/0240898 | A1 | 12/2004 | Nonaka et al. | |
| 2008/0181642 | A1* | 7/2008 | Kishi | 399/69 |
| 2009/0060550 | A1* | 3/2009 | Seo | 399/69 |
| 2009/0148205 | A1* | 6/2009 | Seo et al. | 399/330 |
| 2009/0245897 | A1* | 10/2009 | Seo et al. | 399/328 |
| 2010/0061753 | A1* | 3/2010 | Hase | 399/69 |

FOREIGN PATENT DOCUMENTS

| | | |
|---|---|---|
| JP | 2003-223063 | 8/2003 |
| JP | 2005-235637 | 9/2005 |
| JP | 2008-139475 | 6/2008 |
| JP | 2009-128551 | 6/2009 |

* cited by examiner

*Primary Examiner* — N Drew Richards
*Assistant Examiner* — John P Dulka
(74) *Attorney, Agent, or Firm* — Greenblum & Bernstein, P.L.C.

(57) ABSTRACT

A heating roller performs electromagnetic induction heating, and includes a first exciting coil that heats the heating roller, a first degaussing coil that decreases magnetic fields of the first exciting coil, and a first axial direction core that guides magnetic fluxes, to make up a magnetic circuit between the first axial direction core and the heating roller. The width of a heat zone is controlled in agreement with a sheet feeding area. Thus, the capability to control a temperature increase in a non-sheet-feeding area of the heating roller is enhanced. Power can be saved during continual feeding of small recording sheets.

7 Claims, 11 Drawing Sheets

(I) —— ONLY FIRST HEATING COIL IS USED (PORTRAIT-ORIENTED A3-SIZE SHEET)
(II) —— FIRST HEATING COIL + FIRST DEGAUSSING COIL (PORTRAIT-ORIENTED B4-SIZE SHEET)
(III) - - - - ONLY SECOND HEATING COIL IS USED (PORTRAIT-ORIENTED A4-SIZE SHEET)
(IV) —— SECOND HEATING COIL + SECOND DEGAUSSING COIL (A5)
(V) —— NO FERRITE CORE (PORTRAIT-ORIENTED A3-SIZE SHEET)
(VI) - - - - NO FERRITE CORE (PORTRAIT-ORIENTED A4-SIZE SHEET)

INDUCTION HEATER WITH DIRECTIONAL CORES

BACKGROUND

1. Field of the Invention

The present invention relates to an induction heater used in a fixing unit of an image forming apparatus that fixes a toner image produced on a recording sheet by means of heating and, more particularly, to an induction heater using an electromagnetic induction technique (an IH technique) as a heating technique.

2. Description of the Related Art

There is recently a growing demand for energy conservation and speedup of an image forming apparatus, such as a printer, a copier, and a facsimile. In order to attain the required performance, an improvement in heat efficiency of the fixing unit employed in the image forming apparatus is important.

A proposed technique is for causing a fixing unit of an electromagnetic induction heating type to generate Joule heat from an eddy current that has developed in a magnetic metal member from an alternating field, thereby letting a heating element including a metallic member effect electromagnetic induction heating (JP-A-2003-223063). However, the image forming apparatus has encountered a problem about indefinite sizes of sheets; namely, a necessity for coping with a plurality of widths of sheets.

In order to address the problem, there is another proposed fixing unit of electromagnetic induction heating type including an exciting coil and a sub-induction coil (JP-A-2009-128551). The exciting coil and the sub-induction coil located inside the exciting coil are produced within a single plane. When a circuit is closed by a switch, to thus become short-circuited, the sub-induction coil described in connection with JP-A-2009-128551 is electromagnetically coupled with an exciting coil by way of electric capacity changeover means. When the switch is conversely opened, to thus open the circuit, the sub-induction coil and the exciting coil are brought into an electromagnetically uncoupled state.

Likewise, in order to address various widths of recording sheets, there is available still another proposed fixing unit of electromagnetic induction heating type that cancels magnetic flux by piling stepwise a degaussing coil on an exciting coil (JP-A-2008-139475). In JP-A-2008-139475, an exciting coil is wound around the fixing unit along a fixing roller 1, and a first degaussing coil is placed on the exciting coil. Further, a second degaussing coil is piled on the first degaussing coil in stacked manner. The exciting coil and the degaussing coil are set to the same width.

Incidentally, in a turn portion of an exciting coil of the electromagnetic induction heating type, a temperature drop is likely to arise in the distribution of heat of a heating roller. For this reason, there is also available a proposed fixing unit that prevents occurrence of a temperature drop in the turn portion by providing the turn portion with a magnetic flux focusing member (JP-A-2005-235637). There is used an annular exciting coil including parallel portions that extend in parallel with a heating roller along its longitudinal direction and turn portions that are provided at both ends of the parallel portions. A magnetic flux focusing member is provided at an area of the turn portion where orientations of magnetic fields developing from the turn portion are aligned, thereby preventing occurrence of a temperature drop at an interior of the turn portion. Temperature uniformity of the heating member achieved in its longitudinal direction is thereby enhanced.

According to a paper width control method that is a current mainstream, a degaussing coil capable of addressing various widths of recording sheets is provided on an exciting coil. The degaussing coil is short-circuited in accordance with the size of a recording sheet, thereby cancelling magnetic fluxes of the exciting coils and preventing occurrence of a temperature rise in a non-sheet-feeding area. Meanwhile, an ever-increasing demand recently exists for speedup of the image forming apparatus, and heat capacity of the fixing unit for shortening a warm-up period is reduced year by year. A reduction in heat capacity means that a heating roller is configured so as to become easily heated. Enhancement of the capability to suppress an increase in the temperature of an unused non-sheet-feeding area (i.e., temperature rise controlling capability) has therefore been sought.

However, the fixing unit of electromagnetic induction heating type described in connection with JP-A-2009-128551 has a structure in which the sub-induction coil is coupled to the exciting coil by way of the electric capacity changeover means. The sub-induction coil is placed inside of the exciting coil that is provided in the same plane for controlling magnetic fluxes. A gap is likely to develop between the sub-induction coil and the exciting coil. Even when switching is carried out by the electric capacitance changeover means, magnetic fluxes are not sufficiently canceled, which in turn raises a problem of remaining of some magnetic fluxes. Specifically, under the electromagnetic induction heating method, a temperature rise in the non-sheet-feeding area cannot sufficiently be controlled. Moreover, there is another problem of a necessary quantity of heat becoming conversely deficient in the neighborhoods of both ends of a sheet feeding area. Specifically, a desirable temperature distribution that exhibits a uniform temperature only in the sheet feeding area is not attained. On the other hand, an attained temperature distribution is gradual such that a temperature gradually decreases with a closer approach toward both ends of the sheet feeding area and that the temperature drop further increases with an increasing approach toward the non-sheet-feeding area.

In the fixing unit of electromagnetic induction heading type described in connection with JP-A-2008-139475, a degaussing coil is piled on an exciting coil, and recording sheets of various widths are fixed. However, this type also requires to stack a degaussing coil on an exciting coil in the form of layers, and a gap is likely to develop between the exciting coil and the degaussing coil. Cancellation of the magnetic fluxes performed by the degaussing coil is insufficient, so that some of the magnetic fluxes still remain. Even the fixing unit of this type cannot sufficiently control an increase in the temperature of the non-sheet-feeding area, and heat capacity is likely to become deficient at both ends of the sheet feeding area. Specifically, the temperature distribution does not become uniform in the sheet feeding area but exhibits a decline at each end of the sheet feeding area instead.

SUMMARY

The present invention aims at providing an induction heater that can control a heat zone width in agreement with a sheet feeding area; that exhibits enhanced capability to control an increase in temperature of a non-sheet-feeding area of a heating roller; and that can reduce power when a small-size recording sheet is fed.

In order to solve the problem, an induction heater of the present invention is characterized by including a cylindrical heating roller that performs electromagnetic induction heating; an exciting coil that heats the heating roller; a degaussing coil that is made so as to become shorter than the exciting coil in an axial direction of the heating roller and that decreases magnetic fields of the exciting coil; and a magnetic member that is made of a magnetic material and that guides magnetic fluxes of the exciting coil and/or magnetic fluxes of the degaussing coil, thereby making up a magnetic circuit between the magnetic member and the heating roller, wherein the exciting coil has parallel portions extending in parallel with the axial direction of the heating roller and two turn portions provided at both ends of the parallel portions; the degaussing coil has parallel portions extending in parallel with the axial direction of the heating roller and two turn portions provided at both ends of the parallel portions; there is a common structure that makes it possible to overlay one of the two turn portions and the parallel portions of the exciting coil on one of the two turn portions and the parallel portions of the degaussing coil, and the magnetic member is provided on a remaining side of the two turn portions of the degaussing coil.

BRIEF DESCRIPTION

DETAILED DESCRIPTIONS (First Embodiment)

A first embodiment of the present invention is hereunder described by reference to the drawings.

Figure 1:
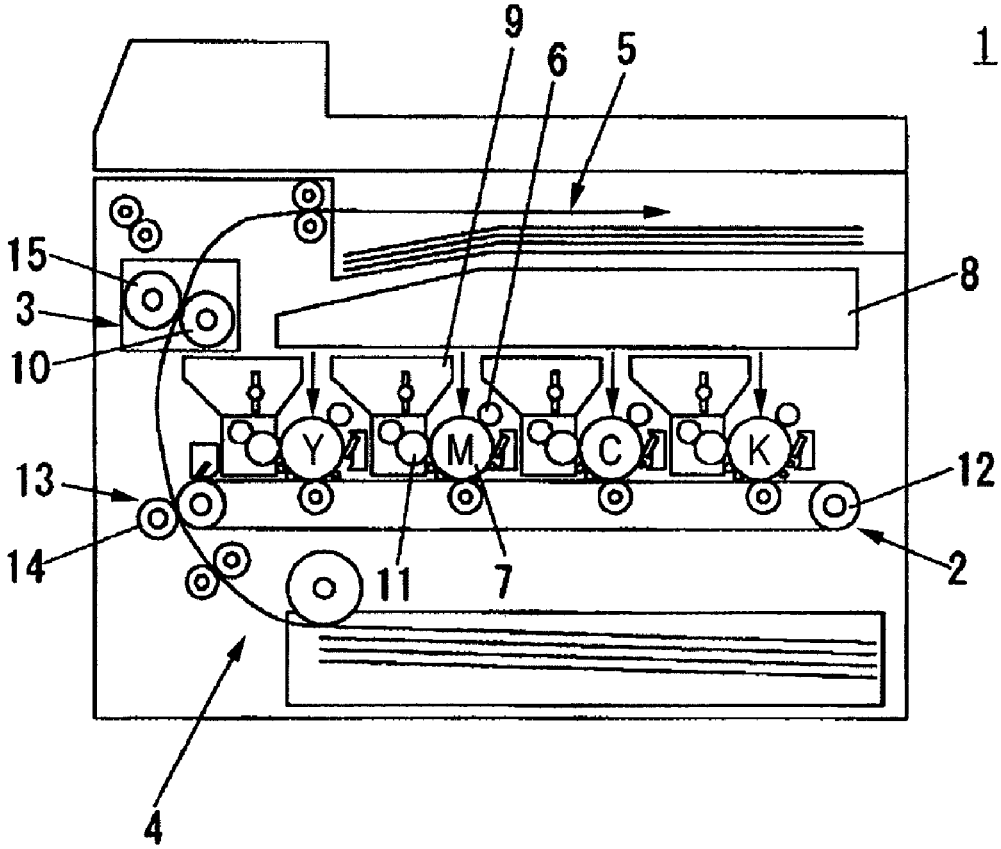
FIG. 1 is a block diagram of a copier to which an induction heater of the present invention applies as a fixing unit.

FIG. 1 is a block diagram of a copier to which an induction heater of the present invention applies as a fixing unit. A copier (an image forming apparatus) shown in FIG. 1 is a tandem color image forming apparatus. The copier includes a document reading section 1 that reads an image of a document; an image production section 2 that produces the read document image on respective photosensitive drums 7 and a toner image from toner and that transfers the toner images on a recording sheet (which is typically an image production medium); and a fixing unit 3 that fixes the toner images on the recording sheet. The image production section 2 is supplied with a recording sheet from a sheet feeding section 4, and a recording sheet having finished undergoing fixing in the fixing unit 3 is output to a sheet output section 5.

In the image production section 2, the photosensitive drums 7 uniformly electrified by corresponding electrifiers 6 are exposed to laser beams emitted from an LSU (Laser Scanning Unit) 8, whereupon electrostatic latent images are produced on surfaces of photosensitive layers of the respective photosensitive drums 7. Subsequently, toner in development units 9 is supplied to the respective photosensitive drums 7 by way of the corresponding development rollers 11, whereupon the electrostatic latent images are developed by the toner. A yellow (Y) photosensitive drum 7, a magenta (M) photosensitive drum 7, a cyan (C) photosensitive drum 7, and a black (K) photosensitive drum 7 are disposed along an intermediate transfer belt. The electrostatic latent images respectively produce toner images from the toner supplied from respective colors of development rollers 11. These toner images are sequentially transferred onto the intermediate transfer belt 12 through primary transfer operation. A toner image resultant from the respective colors of toner images being superimposed one on top of the other on the intermediate transfer belt 12 is further transferred onto a recording sheet by means of a transfer roller 14 of a transfer unit 13 through secondary transfer operation.

Figure 2:
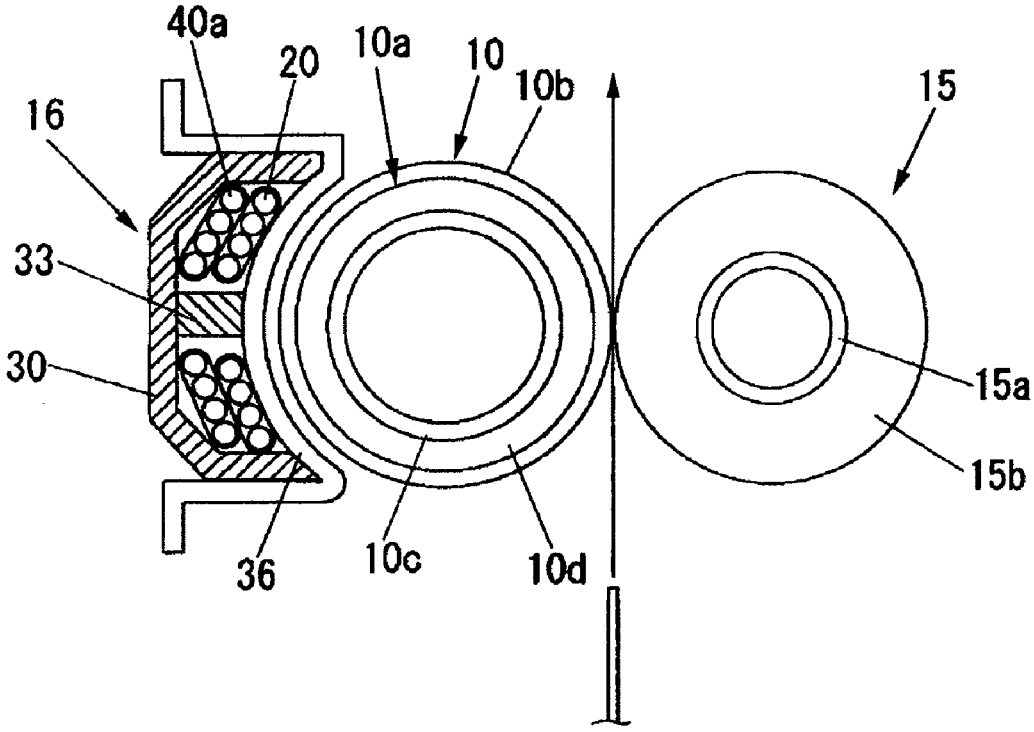
FIG. 2 is a cross sectional view of the fixing unit shown in FIG. 1 to which the induction heater of the present invention applies.

FIG. 2 is a cross-sectional view of the fixing unit of the copier, shown in FIG. 1, to which the induction heater of the present invention applies. As shown in FIG. 2, the fixing unit 3 includes a cylindrical heating roller 10 that fuses a toner image on a recording sheet (an image production medium) by means of electromagnetic induction heat and a pressure roller 15 that is forcefully driven so as to make pressure contact with the heating roller 10. When the recording sheet undergone secondary transfer is conveyed to a nip area between the heating roller 10 and the pressure roller 15, the toner on the recording sheet is fused by heat and pressure developing in the nip area, so that the toner on the recording sheet is thermally fixed.

The descriptions about the first embodiment have mentioned a structure in which the heating roller 10 is directly brought into pressure contact with the pressure roller 15. However, the same basically applies to a structure in which a heating belt whose heat capacity becomes smaller than that of the roller is used, as well. In this case, the heating belt assuming the shape of an endless belt is wrapped around the heating roller and the fixing roller. A recording sheet is caused to pass between the pressure roller disposed opposite the fixing roller and the heating belt to be conveyed, whereby the toner on the recording sheet is fixed to the recording sheet by the action of heat and pressure.

As shown in FIG. 2, the heating roller 10 is provided with a heating roller main body 10*a* that is made of a magnetic metal material, such as stainless steel, and the surface of the heating roller main body 10*a* is coated with a mold releasing agent layer 10*b* made of fluorine resin. A cored bar 10*c* is disposed in the heating roller main body 10*a*, and an elastic layer 10*d* is formed from silicon rubber, or the like, between the cored bar 10*c* and the heating roller main body 10*a*.

On the contrary, the pressure roller 15 includes a cored bar 15*a* made of an aluminum alloy and an elastic layer 15*b* made of silicone rubber around the cored bar 15*a*. A recording sheet is conveyed to a nip area between the heating roller 10 and the pressure roller 15, where the toner is fixed.

An induction heater 16 for heating the heating roller main body 10*a* is disposed at a position proximate to the heating roller 10 on the outer periphery of the heating roller 10. The induction heater 16 has an LC resonance circuit including an exciting coil and a resonance capacitor (not shown in FIG. 2, and see FIG. 7). The LC resonance circuit produces a high-frequency alternating field. When magnetic fluxes generated along the thus-generated alternative field undergo interlinkage with the heating roller main body 10*a*, an eddy current develops in the heating roller main body 10*a*. The heating roller 10 is heated by Joule heat by means of the eddy current and the resistance of the heating roller main body 10*a*, whereby the toner images are thermally fixed on the recording sheet.

Figure 3:
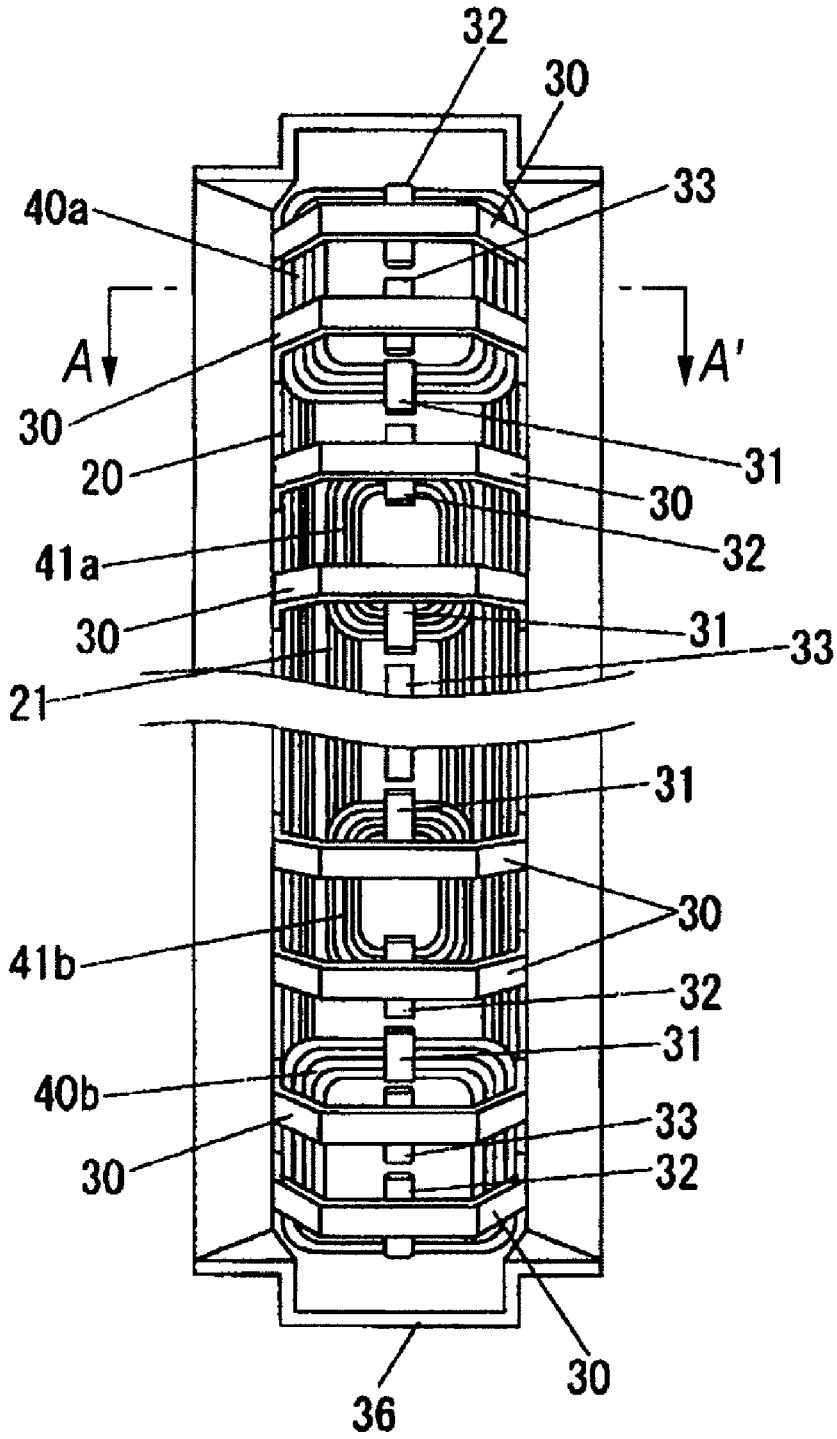
FIG. 3 is an overview of the induction heater of a first embodiment of the present invention.
Figure 4A:
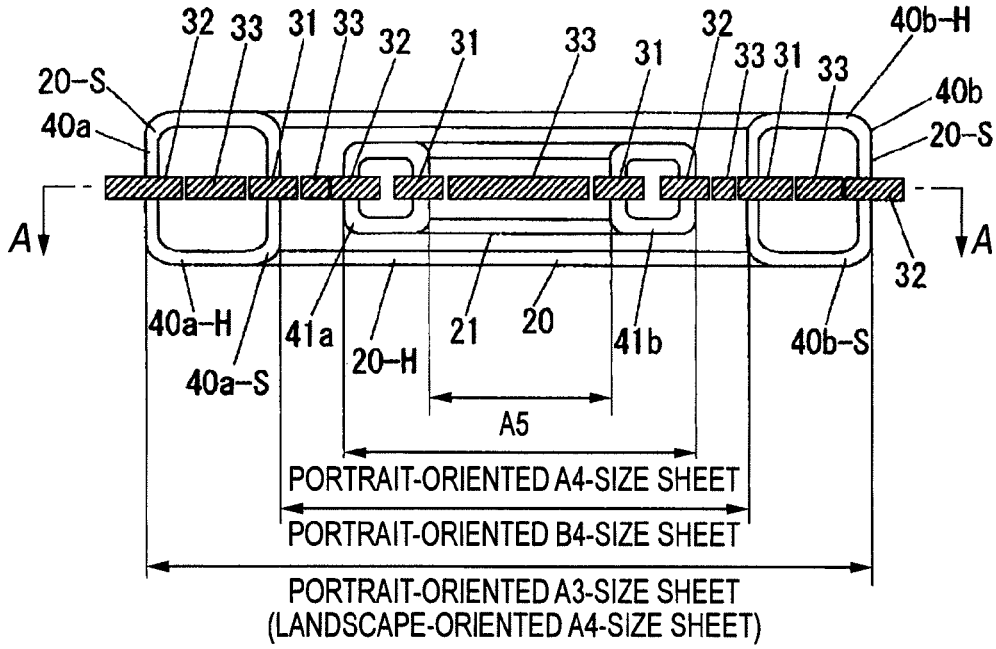
FIG. 4A is a top view of a layout of a coil unit making up the induction heater of the first embodiment of the present invention.
Figure 4B:
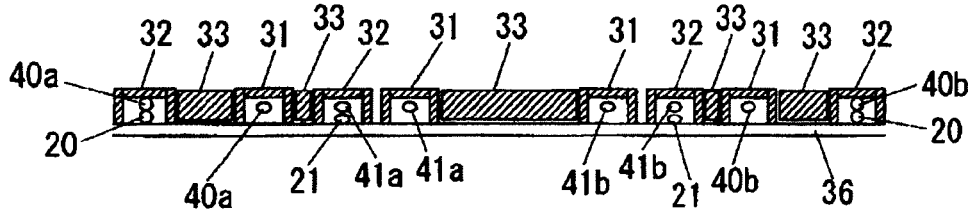
FIG. 4B is a cross sectional view of the layout of the coil unit making up the induction heater of the first embodiment of the present invention taken along line A-A shown in FIG. 4A.
Figure 5A:
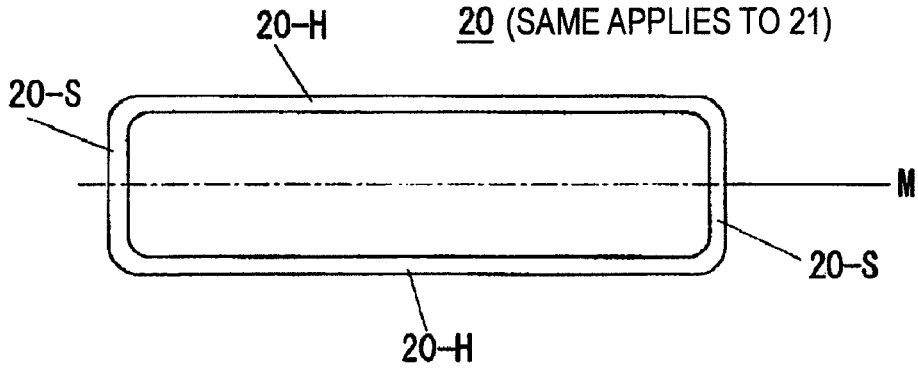
FIG. 5A is a descriptive view of a first degaussing coil making up the induction heater of the first embodiment of the present invention.
Figure 5B:
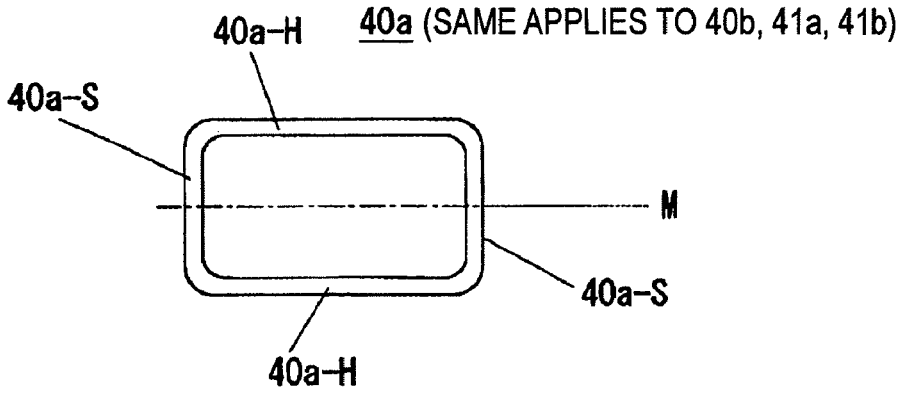
FIG. 5B is a descriptive view of a second degaussing coil making up the induction heater of the first embodiment of the present invention.

FIG. 3 is an overview of the induction heater of the first embodiment of the present invention. The drawing shows an overview of the induction heater 16, when viewed from the back, provided around an outer periphery of the heating roller 10 described in connection with FIG. 2. FIG. 2 includes a portion of a cross section taken along line A-A$^1$ shown in FIG. 3. FIG. 4A is a top view of a layout of a coil unit making up the induction heater of the first embodiment of the present invention. FIG. 4B is a cross sectional view of the layout of the coil unit making up the induction heater of the first embodiment of the present invention taken along line A-A shown in FIG. 4A. FIG. 5A is a descriptive view of a first degaussing coil making up the induction heater of the first embodiment of the present invention. FIG. 5B is a descriptive view of a second degaussing coil making up the induction heater of the first embodiment of the present invention. The induction heater 16 of the first embodiment is of a type that makes up a magnetic circuit from the outer periphery side of the heating roller 10 and that generates heat. The induction heater is also of a double-side reference induction heater that heats the heating roller 10 while taking edges on both sides of respective recording sheets of various sizes as references.

In FIGS. 2, 3, 4A, and 4B, reference numeral 20 designates a first exciting coil of the induction heater 16. The first exciting coil is wound around a radial axis orthogonal to an axis of the heating roller 10 so as to assume a substantially rectangular shape in parallel with a longitudinal direction and a lateral direction of the heating roller 10. The first exciting coil is also connected to a d.c. power supply. Reference numeral 21 designates a second exciting coil that is smaller than the first exciting coil 20 so as to be enclosed with an internal periphery of the first exciting coil 20 and that is wound in such a way that four sides become parallel to the first exciting coil. The second exciting coil 21 is also connected to a d.c. power supply. The first exciting coil 20 heats a recording sheet having the largest width; for instance, an A3-size recording sheet, and has substantially the same width as that of the A3-size recording sheet in its axial direction. The second exciting coil 21 conforms to the width of the third largest recording sheet; for instance, an A4-size recording sheet, and has substantially the same width as that of the A4-size recording sheet in its axial direction.

When a d.c. current is supplied to the first exciting coil 20 and the second exciting coil 21 from the power source, alternating fields develop in the first exciting coil 20 and the second exciting coil 21, because the respective coils make up respective LC resonance circuits. The control circuit (see FIG. 7) controls duty ratios of current waveforms acquired at this time. Magnetic fluxes commensurate with amounts of electric current can be generated. It is better to use a litz wire made by bundling a plurality of insulated copper wires for any of the coils, such as the first exciting coil 20 and the second exciting coil 21.

Incidentally, as shown in FIGS. 3, 4A, and 4B, two degaussing coils (first degaussing coils 40*a* and 40*b*) assigned to the first exciting coil 20 are provided in a two-tier form at respective longitudinal ends of the first exciting coil 20. Two degaussing coils (second degaussing coils 41*a* and 41*b*) assigned to the second exciting coil 21 are provided, in an overlaying manner, at respective ends of the second exciting coil 21 surrounded by the first exciting coil 20. Subscript "a" denotes one longitudinal end of a coil (a left side of the coil in FIGS. 4A and 4B), and "b" denotes the other longitudinal end of the coil (a right side of the coil in FIGS. 4A and 4B). These four degaussing coils are for cancelling portions of the magnetic fluxes of the first exciting coil 20 and the magnetic fluxes of the second exciting coil 21 by means of magnetic fluxes of the degaussing coils. If an increase in the number of widths of recording sheets to be addressed is desired, all you need is to increase the number of exciting coils and degaussing coils.

The first degaussing coils 40*a* and 40*b* of the first embodiment are utilized when a recoding sheet of the second size is heated while induction heating of the first exciting coil 20 is prevented by cancellation of magnetic fluxes. For instance, an A3-size recording sheet is fixed by use of the first exciting coil 20 in the first embodiment. However, in order to fix a B4-size recording sheet, the first degaussing coils 40*a* and 40*b* as well as the first exciting coil 20 are short-circuited. Likewise, the second degaussing coils 41*a* and 41*b* prevent induction heating of the second exciting coil 21, thereby heating a recording sheet of the fourth size. The second degaussing coils 41*a* and 41*b* are short-circuited when an A5-size recording sheet undergoes fixing. It is better to use a litz wire for the first degaussing coils 40*a* and 40*b* and the second degaussing coils 41*a* and 41*b*. Although the embodiment mentions that the magnetic fluxes are canceled by use of the exciting coils and the degaussing coils, the cancellation is intended for sufficiently diminishing magnetic fluxes in an overlapping area between the exciting coils and the degaussing coils. Specifically, the cancellation signifies reducing the magnetic fluxes to a flux density range where occurrence of a temperature rise in the heating roller can be prevented.

Four types of magnetic members used for making up a magnetic circuit are now described. In FIGS. 2, 3, 4A, and 4B, reference numeral 30 designates plate-like conveyance-direction-oriented cores that each have two legs made of a magnetic material and that assumes a substantially-C-shaped form. A plurality of conveyance-direction cores 30 are arranged along a circumferential direction (the direction of conveyance of a recording sheet) orthogonal to the axis of the heating roller 10 so as to straddle the longitudinal direction of the first exciting coil 20. On the contrary, reference numeral 31 designates plate-like first axial direction cores that are aligned to the axial direction of the heating roller 10 (the longitudinal direction of the first exciting coil 20) and placed in a direction orthogonal to the conveyance-direction cores 30 so as to straddle only lateral portions of the first degaussing coil 40*a* at one end (on the left side) of the heating roller 10 and that assume a substantially-C-shaped form. Reference numeral 32 designates plate-like second axial direction cores that are placed in a direction orthogonal to the conveyance-direction cores 30 while oriented in the axial direction of the heating roller 10 so as to simultaneously straddle lateral portions of the two coils; namely, the first exciting coil 20 and the first degaussing coil 40*a* and that assume a substantially-C-shaped form. Even at the other end (the right end) of the heating roller 10, the first axial direction cores 31 and the second axial direction cores 32 are disposed so as to be axially symmetrical with respect to their counterpart cores placed at the one end (the left end). Namely, the first axial direction cores 31 are placed so as to straddle only lateral portions of the respective first degaussing coils 40*b*, and the second axial direction cores 32 are placed so as to simultaneously straddle lateral portions of the first exciting coil 20 and the first degaussing coil 40. The term "substantially-C-shaped form" is employed because the shape of the letter C or opening of legs assumes various forms. From a two-dimensional aspect, the conveyance-direction cores 30 cross the first axial direction cores 31 and the second axial direction cores 32 at right angles, and these cores guide magnetic fluxes oriented in mutually-orthogonal directions. From a three-dimensional aspect, the conveyance-direction cores 30 cross, in a straddling manner, the first axial direction cores 31, the second axial direction cores 32, and third axial direction cores 33 to be described below. The first axial direction cores 31 and the second axial direction cores 32 are also placed with respect to the second exciting coil 21 and the second degaussing coils 41*a* and 41*b*, as for the first exciting coil 20 and the first degaussing coils 40*a* and 40*b*.

In FIGS. 2, 3, 4A, and 4B, reference numeral 33 designates a plate-like third axial direction core provided along the longitudinal direction of the first exciting coil 20 and the second exciting coil 21 (the axial direction of the heating roller 10). The third axial direction cores 33 are magnetic material inserted so as to fill a gap in the location where the first axial direction cores 31 and the second axial direction cores 32 are disposed. The third axial direction cores 33 are intended for effectively guiding magnetic fluxes of the first axial direction cores 31 and the second axial direction cores 32, thereby making up an intensive magnetic circuit between the cores and the heating roller 10.

All of the conveyance direction cores 30, the first axial direction cores 31, the second axial direction cores 32, and the third axial direction cores 33 are made of a magnetic material, such as ferrite, and confine magnetic fields developing from the respective exciting coils and the respective degaussing coils within interiors of magnetic members so as to prevent leakage of the magnetic fluxes. A flow of magnetic fluxes of high flux density is created. Since the magnetic fluxes less pass through air exhibiting low magnetic permeability, the magnetic fluxes concentrate on the areas where there are the magnetic members. The majority of the magnetic fluxes developing in the coils are guided within the first axial direction cores 31, the second axial direction cores 32, and the third axial direction cores 33. The magnetic fluxes go toward the heating roller 10 and undergo interlinkage with the heating roller main body 10*a* that is a magnetic material. An eddy current develops from the magnetic fluxes in the heating roller main body 10*a*, whereby an interior region of the coil generates heat.

The three types of magnetic members (the first axial direction cores 31, the second axial direction cores 32, and the third axial direction cores 33) are for improving flow of magnetic fluxes passing through the magnetic circuit, thereby uniformly inducing an eddy current in the heating roller 10. The magnetic members are interspersed in line with each other along a shaft center of the heating roller within the exciting coil. A plurality of magnetic members are continually positioned and spaced at predetermined intervals that enable magnetic coupling while plates of the magnetic members are aligned along a direction parallel to the parallel portions of the exciting coil. The three types of magnetic members (the first axial direction cores 31, the second axial direction cores 32, and the third axial direction cores 33) are arranged so as to straddle or not intersect in lateral directions of the respective coils. However, it is determined, from a situation of intersection of the coils, which one of the three types of magnetic members is placed. The first axial direction cores 31 are cores employed when the core straddles only one coil. The second axial direction cores 32 are cores employed when the core simultaneously straddles two coils. The third axial direction cores 33 are arranged when the cores do not cross any coil.

In FIGS. 2, 3, 4A, and 4B, reference numeral 36 designates a coil holding member of the induction heater 16. The coil holding member 36 is made of a non-magnetic material and has a concave surface that opposes a cylindrical surface of the heating roller 10, to thus accept the convex surface. The cylindrical concave surface is separated, by a predetermined space, apart from the convex surface of the heating roller 10 used for making up a magnetic circuit. In the coil holding member 31, a gutter-shaped long space is provided on the back of the concave. The first exciting coil 20, the second exciting coil 21, the first degaussing coils 40*a* and 40*b*, the second degaussing coils 41*a* and 41*b*, the conveyance direction cores 30, the first axial direction cores 31, the second axial direction cores 32, and the third axial direction cores 33 are mounted within the space.

By reference to FIGS. 5A and 5B, more specific explanations are provided for the structures of and the installation method for the exciting coils, the degaussing coils, and the magnetic members provided in the coil unit of the induction heater of the first embodiment.

First, the exciting coils and the degaussing coils are described.

As shown in FIG. 5A, each of the first exciting coil 20 and the second exciting coil 21 includes two parallel portions extending along a shaft M of the heating roller 10 and two turn portions that connect both ends of the parallel portions. Likewise, as shown in FIG. 5B, each of the first degaussing coils 40*a*, 40*b* and the second degaussing coils 41*a*, 41*b* also has parallel portions and turn portions. Therefore, the first exciting coil 20 and the second exciting coil 21 become substantially rectangular coils.

Provided that a horizontal portion of the coil is denoted by H and a turn portion of the coil is denoted by S. A parallel portion of the first exciting coil 20 is denoted by 20-H, and a parallel portion of the second exciting coil 21 (the second exciting coil 21 is not illustrated in FIG. 5A) is denoted by 21-H. Further, a turn portion of the first exciting coil 20 is denoted by 20-S, and a turn portion of the second exciting coil 21 is denoted by 21-S. A parallel portion of the first degaussing coil 40*a* is denoted by 40*a*-H, and a parallel portion of the first degaussing coil 40*b* is denoted by 40*b*-H. Further, a turn portion of the first degaussing coil 40*a* is denoted by 40*a*-S, and a turn portion of the first degaussing coil 40*b* is denoted by 40*b*-S (the first degaussing coil 40*b* is not illustrated in FIG. 5B). Likewise, a parallel portion of the second degaussing coil 41*a* is denoted by 41*a*-H, and a parallel portion of the second degaussing coil 41*b* is denoted by 41*b*-H. Further, a turn portion of the second degaussing coil 41*a* is denoted by 41*a*-S, and a turn portion of the second degaussing coil 41*b* is denoted by 41*a*-S (the second degaussing coils 41*a* and 41*b* are not illustrated in FIG. 5B).

As shown in FIGS. 2, 3, 4A, and 4B, the first exciting coil 20 is attached to the coil holding member 36 in such a way that the longitudinal direction of the first exciting coil is aligned with the axis of the heating roller 10. The induction heater 16 of the first embodiment is of a double-side reference heating type. One side of a C-shaped end of the first exciting coil 20 and the first degaussing coil 40*a* are vertically aligned to each other in the vicinity of one end of the heating roller 10. Likewise, one side of the other C-shaped end of the first exciting coil 20 and the first degaussing coil 40*b* are vertically aligned to each other in the vicinity of the other end of the heating roller 10. As a result, the first degaussing coils 40*a* and 40*b* are piled on the first exciting coil 20 in a two-tier form in such a way that three sides of each of the first degaussing coils are vertically aligned to the first exciting coil 20.

Specifically, the first degaussing coil 40*a* at one end and the first exciting coil 20 are arranged in such a way that two sets of parallel portions H (i.e., each set consisting of one parallel portion 40*a*-H and a corresponding parallel portion 20-H) and one set of turn portions S at one end [i.e., the set consisting of only one turn portion 40*a*-S and a corresponding one turn portion 20-S at one end (on the left side)] are positionally aligned to each other and stacked into a two-tier form. On the contrary, the first degaussing coil 40*b* at the other end and the first exciting coil 20 are arranged in such a way that two sets of parallel portions H (i.e., each set consisting of one parallel portion 40*b*-H and a corresponding parallel portion 20-H) and one set of turn portions S at one end [i.e., the set consisting of only one turn portion 40*b*-S and a corresponding one turn portion 20-S at the other end (on the right side)] are positionally aligned to each other and stacked into a two-tier form.

The second exciting coil 21 is provided in and enclosed by the first exciting coil 20. The parallel portions H and the turn portions S of the second exciting coil 21 are placed equidistant from the parallel portions H and the turn portions S of the first exciting coil 20. However, they do not need to be equidistantly spaced apart from each other. The second degaussing coil 41*a* is positioned, as is the first degaussing coil 40*a*, in such a way that three sides of the degaussing coil at one end thereof overlap a corresponding end of the second exciting coil 21. The second degaussing coil 41*b* is positioned, as is the first degaussing coil 40*b*, in such a way that three sides of the degaussing coil at the other end thereof overlap a corresponding end of the second exciting coil 21. Specifically, the second degaussing coil 41*a* at one end and the second exciting coil 21 are arranged in such a way that two sets of parallel portions H (i.e., each set consisting of one parallel portion 41*a*-H and a corresponding parallel portion 21-H) and one set of turn portions S at one end (i.e., the set consisting of only one turn portion 41*a*-S and a corresponding one turn portion 21-S) are positionally aligned to each other and stacked into a two-tier form. On the contrary, the second degaussing coil 41*b* at the other end and the second exciting coil 21 are arranged in such a way that two sets of parallel portions H (i.e., each set consisting of one parallel portion 41*b*-H and a corresponding parallel portion 21-H) and one set of turn portions S at one end (i.e., the set consisting of only one turn portion 41*b*-S and a corresponding one turn portion 21-S at the other end) are positionally aligned to each other and stacked into a two-tier form.

The first exciting coil 20, one of the two turn portions S and the two parallel portions H of the first degaussing coil 40*a*, and one of the two turn portions S and the two parallel portions H of the second degaussing coil 40*b* are given an electromagnetically or physically common structure so that they can be stacked one on top of the other in an overlapping fashion. Likewise, the second exciting coil 21, one of the two turn portions S and the two parallel portions H of the second degaussing coil 41*a*, and one of the two turn portions S and the two parallel portions H of the second degaussing coil 41*b* are given an electromagnetically or physically common structure so that they can be stacked one on top of the other in an overlapping fashion. The first exciting coil 20 and the first degaussing coils 40*a* and 40*b* are coils having the same number of turns, wherein coils, each of which has a common cross sectional profile, are stacked into a two-tier form while three sides of the respective coils overlap each other. Moreover, each of the second exciting coil 21 and the second degaussing coils 41*a* and 41*b* is also a coil having the same number of turns. Coils having common cross sectional profiles are stacked into a two-tier form while there sides thereof are aligned to each other. Accordingly, when electric currents having the same current value are caused to flow, in opposite directions, into the first exciting coil 20 and the first degaussing coils 40*a*, 40*b* and also into the second exciting coil 21 and the second degaussing coils 41*a*, 41*b* whereby magnetic fluxes passing through overlaps between the exciting coils and the degaussing coils cancel each other. Consequently, two types of exciting coils (i.e., the first exciting coil 20 and the second exciting coil 21) and four types of degaussing coils (the first degaussing coils 40*a*, 40*b* and the second degaussing coils 41*a*, 41*b*) are combined together, thereby making it possible to let the heating roller 10 heat in conformance with various widths of recording sheets. Thus, a heat zone width can be controlled according to the width of a sheet. Although the magnetic fluxes are described as if they were canceled by use of the exciting coils and the degaussing coils, the magnetic fluxes are actually, sufficiently diminished by use of the exciting coils and the degaussing coils as mentioned previously.

Figure 6:
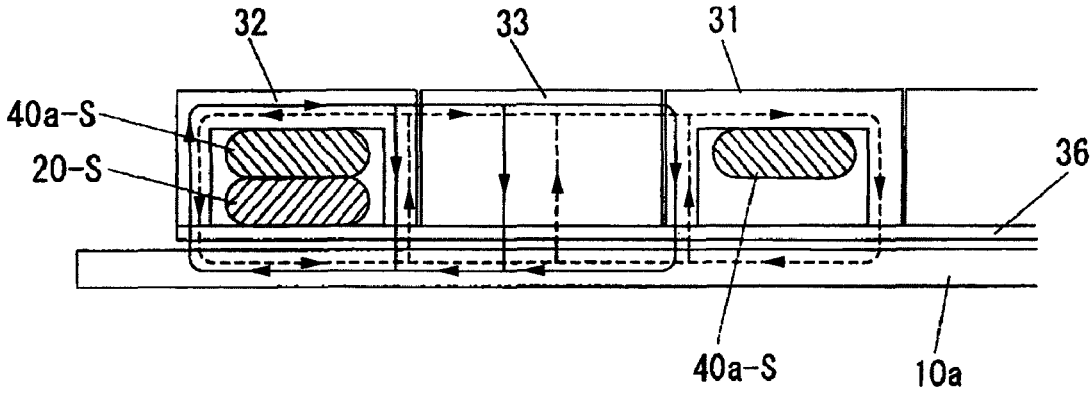
FIG. 6 is a descriptive view showing an enlarged principal section of the coil unit making up the induction heater of the first embodiment of the present invention.

Incidentally, action of the magnetic members is critical to cancelling magnetic fluxes. FIG. 6 is a descriptive view showing an enlarged principal section of the coil unit making up the induction heater of the first embodiment of the present invention. As shown in FIG. 6, each of the first axial direction cores 31 is positioned so as to straddle only the turn portion 40*a*-S of one side (a lateral side) of the first degaussing coil 40*a* in a right-side area of the left end of the heating roller 10. On the contrary, each of the second axial direction cores 32 is positioned so as to straddle respective sides (the turn portions 20-S and 40*a*-S) of the two coils; namely, the first exciting coil 20 and the first degaussing coil 40*a*. The first axial direction cores 31 and the second axial direction cores 32 assume a substantially-C-shaped form having two legs. Both ends of the two legs of the letter C are oriented toward and positioned close to the cylindrical surface of the heating roller 10. Further, each of the third axial direction cores 33 is placed between the corresponding first axial direction core 31 and the corresponding second axial direction core 32 so as to compensate for a gap, whereby the majority of magnetic fluxes can be confined within the magnetic members, and the flux density of the magnetic circuit can be enhanced.

FIG. 6 shows portions of the magnetic fluxes generated by the first exciting coil 20 at a certain point in time by means of application of an alternating current. As shown in FIG. 6, the magnetic fluxes pass through the second axial direction cores 32, the third axial direction cores 33, and the first axial direction cores 31 that are magnetic members, to thus be guided in a direction denoted by a solid line without involvement of substantial leakage of the magnetic fluxes. Specifically, the magnetic fluxes (see FIGS. 4 and 6) generated by the first exciting coil 20 are guided through the first axial direction cores 31, the second axial direction cores 32, and the third axial direction cores 33, to thus undergo interlinkage with the heating roller main body 10*a* and make up a magnetic circuit. The heating roller main body 10*a* is thus generated by an eddy current. A recording sheet having a width equivalent to the axial length of the first exciting coil 20 can thereby undergo fixing performed by the first exciting coil 20.

When an a.c. current is applied to both the first exciting coil 20 and the first degaussing coil 40*a*, magnetic fluxes generated by the first degaussing coil 40*a* pass through the second axial direction cores 32, the third axial direction cores 33, and the first axial direction cores 31, to thus be guided along directions of broken lines shown in FIG. 6. Although unillustrated in FIG. 6, the same phenomenon occurs in the first degaussing coil 40*b* on the other end. The magnetic fluxes of the first degaussing coils 40*a* and 40*b* are guided at this time by the first axial direction cores 31, the second axial direction cores 32, and the third axial direction cores 33 (see FIGS. 4A, 4B, and 6), to thus undergo interlinkage with the heating roller main body 10*a*. As shown in FIG. 6, the magnetic fluxes generated by the first exciting coil 20 and the magnetic fluxes generated by the first degaussing coil 40*a* become opposite in directions within the second axial direction cores 32 and the third axial direction cores 33, to thus cancel each other.

However, the first exciting coil 20 includes the turn portion 40*a*-S of the first degaussing coil 40*a* (the turn portion shown in FIG. 6) where the first degaussing coil 40*a* is not stacked on the first exciting coil 20 in a two-tier manner. Magnetic fluxes are not canceled in the area of the turn portion. The magnetic fluxes that have not been canceled are guided through interiors of the respective first axial direction cores 31, to thus undergo interlinkage with the heating roller main body 10*a*. The heating roller main body 10*a* is thus heated by an eddy current. The same also completely applies to the turn portion 40*b*-S of the first degaussing coil 40*b* (not shown).

Specifically, when the first exciting coil 20 and the first degaussing coils 40*a* and 40*b* are simultaneously short-circuited, the turn portions 40*a*-S and 40*b*-S of the first degaussing coils 40*a* and 40*b* located closer to respective centers of the exciting coils perform heating in lieu of the two turn portions 20-S provided at both ends of the first exciting coil 20. The magnetic fluxes in the area enclosed by the first degaussing coils 40*a* and 40*b* come to be canceled. Accordingly, so long as the first degaussing coils 40*a* and 40*b* are positioned at both ends of the first exciting coil 20 in a two-tier form by use of the first degaussing coils 40*a* and 40*b*, it is possible to provide the first degaussing coils 40*a* and 40*b* with a function (heating action) serving as a substitute for heating action of the first exciting coil 20 as well as degaussing action. Thus, a recording sheet whose width is shorter than the length of the first exciting coil 20 by an amount equivalent to a sum of widths of the first degaussing coils 40*a* and 40*b* can be subjected to fixing.

A uniform temperature distribution of the heating roller 10 cannot be easily attained by use of only the first degaussing coils 40*a* and 40*b* when degaussing operation is performed by means of the first degaussing coils 40*a* and 40*b* as mentioned above, and a decline is likely to arise in temperature distribution at both ends of the first exciting coil 20. Specifically, a uniform temperature of the heating roller 10 is not achieved at a position between the turn portions 40*a*-S of the first degaussing coil 40*a* and a position between the turn positions 40*b*-S of the first degaussing coil 40*b*. Further, a sharp temperature decline does not arise in the vicinities of the turn portions 40*a*-S and 41*a*-S. This means an increase in the temperature of the non-sheet-feeding area.

Therefore, it is important to increase the flux density of the turn portions 40*a*-S and 40*b*-S where no overlap exists between the first degaussing coils 40*a*, 40*b* and the first exciting coil 20, to thus confine the majority of magnetic flux in the magnetic members; to guide the magnetic flux so as to undergo interlinkage with the heating roller main body 10*a*. For this reason, in the first embodiment, the turn portions 40*a*-S and 40*b*-s are respectively provided with the first axial direction cores 31. Flux density that is achieved at the turn portions 40*a*-S and 40*b*-S when the first degaussing coils 40*a* and 40*b* perform degaussing operation is enhanced to a much greater extent, so that the capability to control a temperature rise is enhanced. For these reasons, the temperatures of the non-sheet-feeding areas significantly decrease, and power saving can be attained when a small-size recording sheet is fed. Moreover, the conveyance direction cores 30 are positioned around the exciting coils along with the second axial direction cores 32 and the third axial direction cores 33 as well as with the first axial direction cores 31. This contributes to achieving a more uniform temperature distribution and further power conservation.

Figure 7:
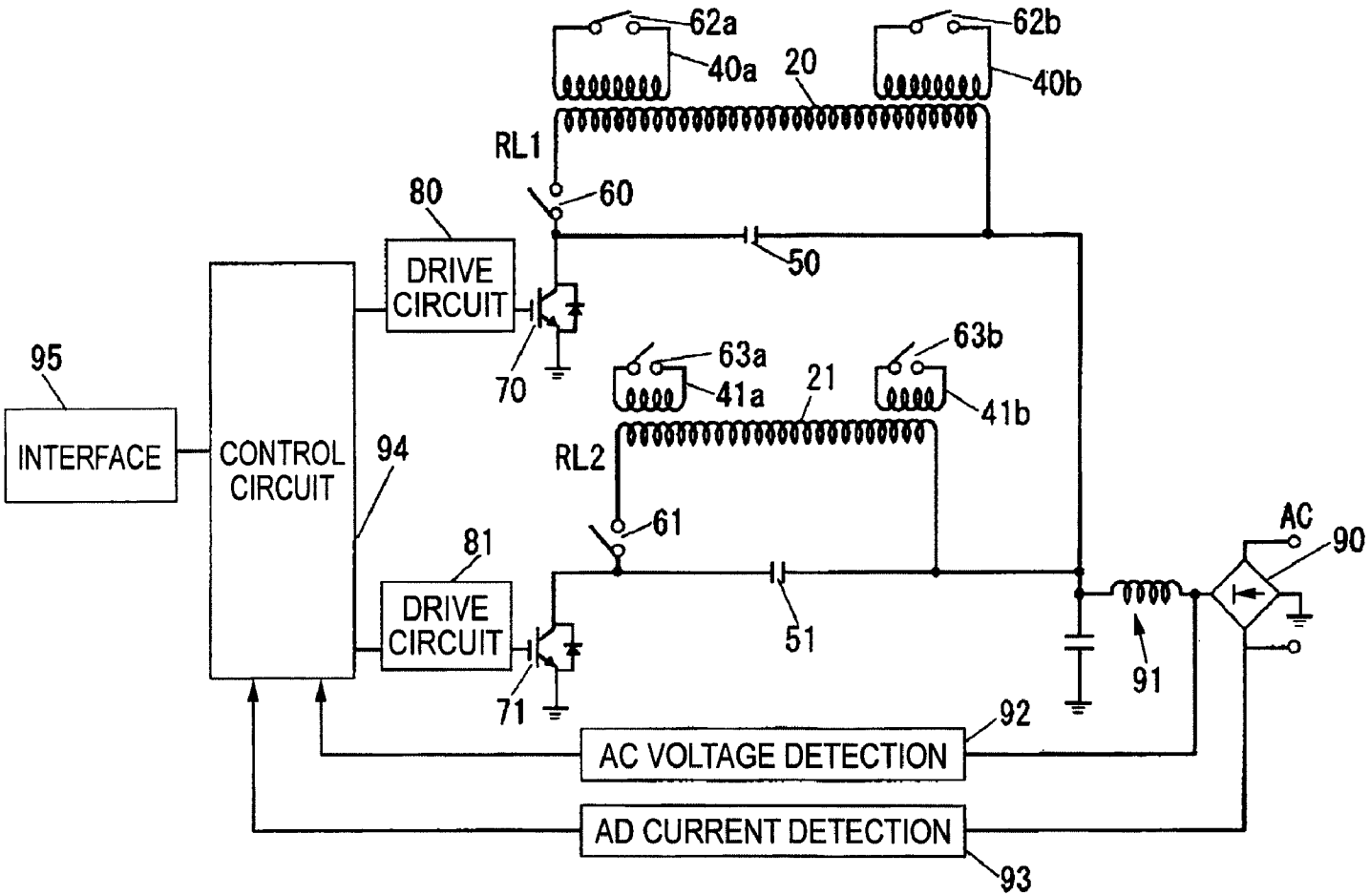
FIG. 7 is a basic circuit diagram of the coil unit making up the induction heater of the first embodiment of the present invention.

The drive circuit that performs electromagnetic induction heating is now described. FIG. 7 is a basic circuit diagram of the coil unit making up the induction heater of the first embodiment of the present invention In the first embodiment, as shown in FIG. 7, the first exciting coil 20 and a resonance capacity 50 are connected in parallel to each other, thereby making up an LC resonance circuit. The second exciting coil 21 and a resonance capacitor 51 are also connected in parallel to each other, thereby making up an LC resonance circuit. A drive circuit 80 controls a switching element 70, whereby the switching element is turned on and off. A drive circuit 81 controls a switching element 71, whereby the switching element is turned on and off. A relay contact point (RL1) 60 is interposed between the first exciting coil 20 and the resonance capacitor 50. When the relay contact point 60 is switched to a closed position, the LC resonance circuit can induce resonance. When the relay contact point 60 is switched to an open state, the LC resonance circuit is opened, so that the first exciting coil 20 is not excited. Likewise, a relay contact point (RL2) 61 is provided between the second exciting coil 21 and the resonance capacitor 51. Only when the relay contact point 61 is switched to a closed position, the LC resonance circuit can induce resonance. When the relay contact point is switched to an open position, the LC resonance circuit is opened, so that the second exciting coil 21 is not excited.

In contrast, the first degaussing coils 40*a* and 40*b* are circuits that are electromagnetically coupled to the first exciting coil 20 according to conditions, like a transformer. Specifically, the first degaussing coil 40*a* is equipped with a relay contact point 62*a*, and the first degaussing coil 40*b* is equipped with a relay contact point 62*b*. When the relay contact points 62*a* and 62*b* are switched to their closed positions, circuits connected to the relay contact points are short-circuited, whereupon the first degaussing coils 40*a* and 40*b* are electromagnetically coupled to the first exciting coil 20. When the relay contact points 62*a* and 62*b* are switched to their open positions, the circuits are brought into an open state, whereupon the first degaussing coils 40*a* and 40*b* are electromagnetically disconnected from the first exciting coil 20. The second degaussing coils 41*a* and 41*b* are likewise electromagnetically coupled to the second exciting coil 21 according to conditions. Specifically, the second degaussing coil 41*a* is equipped with a relay contact point 63*a*, and the second degaussing coil 41*b* is equipped with a relay contact point 63*b*. When the relay contact points 63*a* and 63*b* are switched to their closed positions, circuits connected to the relay contact points are short-circuited, whereupon the second degaussing coils 41*a* and 41*b* are electromagnetically coupled to the first exciting coil 20, like a transformer. When the relay contact points 63*a* and 63*b* are switched to their open positions, the circuits are brought into an open state, whereupon the second degaussing coils 41*a* and 41*b* are electromagnetically disconnected from the first exciting coil 20.

When the size of a recording sheet is designated, the relay contact points 60 and 61 are switched to the open and closed positions by means of excitation of a relay coil (not shown) whose energization is controlled by a control circuit 94. By means of un-illustrated relay circuitry, the control circuit 94 implements combinations of four excitation modes (1), (2), (3), and (4) by combinations of open and closed modes of the relay contact point 60 (hereinafter abbreviated as symbol "A"), the relay contact point 61 (hereinafter abbreviated as symbol "B"), the relay contact points 62*a* and 62*b* (hereinafter abbreviated as symbol "C"), and the relay contact points 63*a* and 63*b* (hereinafter abbreviated as symbol "D").

Among the four combinations, the excitation mode (1) is an excitation mode of circuitry including A in a closed mode, B in an open mode, C in an open mode, and D in an open mode. The excitation mode (2) is an excitation mode achieved by means of A in a closed mode, B in an open mode, C in a closed mode, and D in an open mode. Further, the excitation mode (3) is an excitation mode of circuitry including A in an open mode, B in a closed mode, C in an open mode, and D in an open mode. The excitation mode (4) is an excitation mode implemented by a combination of A in an open mode, B in a closed mode, C in an open mode, and D in a closed mode. Independent, separate control of opening and closing actions of A, B, C, and D is intended for giving consideration to electromagnetic induction operation developing among the coils.

Specifically, the reason for this is that, even if B (the relay contact point 61) is switched from the open position to the closed position while, for instance, A (the relay contact point 60) is held in the closed position, to thus turn off the switching element 70 because of a connection to the resonance capacitor 50, a degaussing current will flow into the first exciting coil 20 and the resonance capacitor 50 by means of electromagnetic induction when an electric current flows to the second exciting coil 21. As a result, a phase shift occurs in the resonance capacitor 50 at this time, and there may be the case where the first exciting coil 20 will produce heat. Accordingly, on the occasion of control of the width of a sheet, it is important to switch among the excitation combinations (1), (2), (3), and (4) by means of the A, B, C, and D without fail.

When the A3-size recording sheet is heated, the relay contact point 60 is closed by controlling the relay circuitry, thereby switching all of the relay contact point 61, the relay contact points 62*a* and 62*b*, and the relay contact points 63*a* and 63*b* to their open positions. When a B4-size recording sheet is heated, both the relay contact point 60 and the relay contact points 62*a*, 62*b* are closed, thereby short-circuiting the first degaussing coils 40*a* and 40*b*. The relay contact point 61 and the relay contact points 63*a* and 63*b* are switched to their open positions at this time. Next, when an A4-size recording sheet is heated, the relay contact point 61 is switched to the closed position, and the relay contact point 60, the relay contact points 62*a* and 62*b*, and the relay contact points 63*a* and 63*b* are switched to their open positions. When an A5-size recording sheet is heated, the relay contact point 61 is switched to the closed position, and the relay contact points 63*a* and 63*b* are also switched to their closed positions, thereby short-circuiting the second degaussing coils 41*a* and 41*b*. The relay contact point 60 and the relay contact points 62*a* and 62*b* are held in the open positions.

In the above-described coil unit, circuit operation of the drive circuit for effecting electromagnetic induction heating is described. A power source is a commercial power source (AC). Electricity is rectified by a rectifying circuit 90, whereby electric power is supplied to the respective LC resonance circuits by way of a filtering circuit 91. A frequency of a high-frequency power source is determined by inductances L of the respective coils and capacitances C of the resonance capacitor.

An output from the rectifying circuit 90 is subjected to electric detection in an AC current detection section 93 including a current transformer. Further, the output is subjected to voltage detection in an AC voltage detection section 92 including a voltage conversion transformer. Respective detection signals are input to a control circuit 94. The control circuit 94 is a computer, or the like, and processing of respective functions is performed as a result of a CPU, which serves as hardware, executing a control program. The control circuit 94 receives a control command from the outside (an image forming apparatus) by way of an interface 95 to the outside. When the size of a recording sheet is designated, relay coils are activated by means of the command signal from the interface 95, thereby switching the respective exciting coils and the degaussing coils and also switching the switching elements 70 and 71 between ON and OFF.

For instance, when an A3-size recording sheet undergoes fixing, the relay circuit switches the relay contact point 60 to the closed position and also switches the relay contact point 61, the relay contact points 62*a* and 62*b*, and the relay contact points 63*a* and 63*b* to the open positions. When the switching element 70 is switched to an ON position in this state, a sawtooth electric current flows into the first exciting coil 20, whereupon energy is stored in the first exciting coil 20. When the switching element 70 is switched to the OFF position, the energy stored in the first exciting coil 20 is discharged to the parallelly-connected resonance capacitor 50, whereupon the energy is in turn stored in the resonance capacitor 50. When the energy stored in the first exciting coil 20 has run out, the resonance capacitor 50 starts discharging electricity in an opposite direction this time, thereby performing resonance operation. When the energy discharged from the resonance capacitor 50 has run out, electricity is regenerated for the power source from the energy again stored in the first exciting coil 20 by way of a built-in capacitor of the resonance capacitor 50 and a built-in capacitor of the switching element 70. When the switching element 70 is turned on, the electricity again flows into the first exciting coil 20, whereby operation of the foregoing cycles is iterated.

When a B4-size recording sheet undergoes fixing, the relay circuit switches the relay contact point 60 to the closed position and the relay contact points 62*a* and 62*b* to their closed positions. The relay contact point 61 and the relay contact points 63*a* and 63*b* are brought into their open positions. When the switching element 70 is turned ON in this state, an electric current flows into the first exciting coil 20, whereby the short-circuited first degaussing coils 40*a* and 40*b* are electromagnetically coupled to the first exciting coil 20, and a degaussing electric current flows into the first degaussing coils 40*a* and 40*b*. Some of the magnetic fluxes caused by the first exciting coil 20 are canceled by action of the first degaussing coils 40*a* and 40*b*.

Likewise, when an A4-size recording sheet undergoes fixing, the relay contact point 61 is switched to the closed position, and the relay contact point 60, the relay contact points 62*a* and 62*b*, and the relay contact points 63*a* and 63*b* are switched to their open positions. The switching element 71 is toggled between the ON position and the OFF position in this state. When an A5-size recording sheet is heated, the relay contact point 61 is switched to the closed position, and the relay contact points 63*a* and 63*b* are also switched to their closed positions. The relay contact point 60 and the relay contact points 62*a* and 62*b* are switched to their open positions. The switching element 71 is toggled between the ON position and the OFF position in this state. The thus-short-circuited second degaussing coils 41*a* and 41*b* are electromagnetically coupled to the second exciting coil 21, whereby a degaussing electric current flows to the second degaussing coils 41*a* and 41*b*. Some of the magnetic fluxes produced by the second exciting coil 21 are canceled by actions of the second degaussing coils 41*a* and 41*b*.

Figure 8:
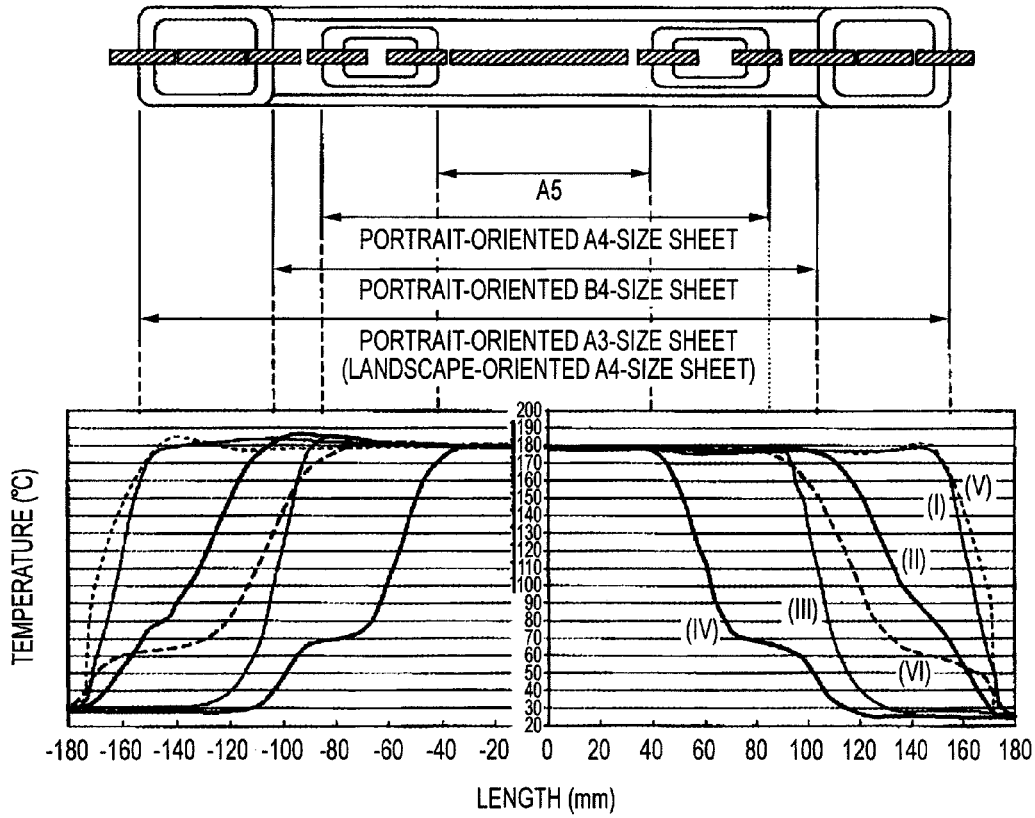
FIG. 8 is a graph showing a temperature distribution of a heating roller of the induction heater of the first embodiment of the present invention.

In the first embodiment of the present invention, the degaussing coils and the exciting coils are given a common structure as mentioned above. The degaussing coils are stacked on the exciting coil so as to assume a two-tier form while three sides of each of the degaussing coils are aligned to a corresponding side of the exciting coil, and a magnetic member is provided in a turn portion of a remaining side of each of the degaussing coils. It becomes thereby possible to control a heat zone width commensurate with a sheet feeding area and enhance the capability to control a temperature rise which will occur when degaussing operation is performed by means of the degaussing coils. There is adopted a structure in which an exciting coil is separated into a first exciting coil and a second exciting coil instead of use of a single exciting coil; in which degaussing coils are stacked on each of the exciting coils in a two-tier form; and in which a smaller recording sheet is subjected to fixing by use of the second exciting coil. Therefore, when compared with a structure in which a single exciting coil is degaussed by means of a plurality of types of degaussing coils, greater power saving can be accomplished during feeding of small recording sheets. FIG. 8 is a graph showing a temperature distribution of a heating roller of the induction heater of the first embodiment of the present invention. Reference numerals (I), (II), (III), and (IV) shown in FIG. 8 denote temperature distributions of the induction heater equipped with the first axial direction cores 31, the second axial direction cores 32, and the third axial direction cores 33, such as those shown in FIGS. 4A and 4B. On the contrary, reference numerals (V) and (VI) denote temperature distributions of the induction heater that is not equipped with such the directional cores. In FIG. 8, the induction heaters are not equipped with the conveyance direction cores 30.

Curves denoted by (I) and (V) shown in FIG. 8 represent temperature distributions appearing when power was supplied solely to the first exciting coil 20, thereby vertically heating an A3-size recording sheet. In the case of a curve denoted by (V), gradients of temperature drops appeared at both ends of the recording sheet are gentle. In contrast, in the case of the curve denoted by (I), temperatures sharply, quickly descend at both ends of the sheet. The sharp temperature decreases show that temperature increase control capability was enhanced as a result of the first axial direction cores 31, the second axial direction cores 32, and the third axial direction cores 33 being disposed in the first exciting coil 20.

The curve denoted by (II) shown in FIG. 8 shows a temperature distribution appeared when a B4-size recording sheet was vertically heated by feeding electric power to the first exciting coil 20 and the first degaussing coils 40*a* and 40*b*.

The curves (Ill) and (VI) represent temperature distributions appeared when the A4-size recording sheet was vertically heated by feeding electric power to the second exciting coil 21. According to the temperature distributions, in the case of the curve denoted by (VI), considerable temperature drops appear at both ends of the recording sheet, and gradients of the temperature drops and temperature descending actions achieved around the ends are gentle. On the contrary, the curve denoted by (III) exhibits rapid, acute temperature drops at both ends of the A4-size recording sheet. The difference between the curves (III) and (VI) lies in that second axial direction cores 32 are attached to the second exciting coil 21. The curve denoted by (VI) exhibits a temperature distribution close to the temperature distribution for an A5-size recording sheet rather than to the temperature distribution for the A4-size recording sheet. When electric power is fed to the second degaussing coils 41*a* and 41*b* simultaneously to the second exciting coil 21, a temperature rapidly descends at both ends of the A5-size recording sheet as in the case of the curve denoted by (IV). Temperature distributions appeared between the respective turn portions can be made substantially uniform according to the size of an individual recording sheet, so that an acute temperature drop can be caused to appear in areas outside the turn portions. A temperature rise control effect is extremely acute.

As mentioned above, the first axial direction cores 31 are provided on the first degaussing coils 40*a* and 40*b* or on the second degaussing coils 41*a* and 41*b*. Further, the second axial direction core 32 is provided on the first exciting coil 20 or the second exciting coil 21, whereby the capability to control a temperature rise in the non-sheet-feeding area of the induction heater 16 can be enhanced. It is possible to curtail electric power wasted as a result of heat traveling to the surroundings during continual feeding of small recoding sheets.

(Second Embodiment)

An induction heater of a second embodiment of the present invention is of a type in which a magnetic circuit is made on the outer periphery side of the heating roller 10, to thus heat the heating roller as in the case with the first embodiment. As distinct from the induction heater of the first embodiment, the induction heater of the second embodiment is a single-side reference induction heater that heats the heating roller 10 by means of taking only an edge on one side of a recording sheet as a reference. The second embodiment also matches the first embodiment in view of the principal configuration. Therefore, reference is also made to FIGS. 1 through 8 even in connection with the second embodiment. When compared with the reference numerals assigned to the configuration of the first embodiment, reference numerals of the order of a hundred are basically assigned to the configuration of the second embodiment. For instance, as compared with the first exciting coil 20 of the first embodiment, the first exciting coil of the second embodiment is assigned reference numeral 120.

Figure 9A:
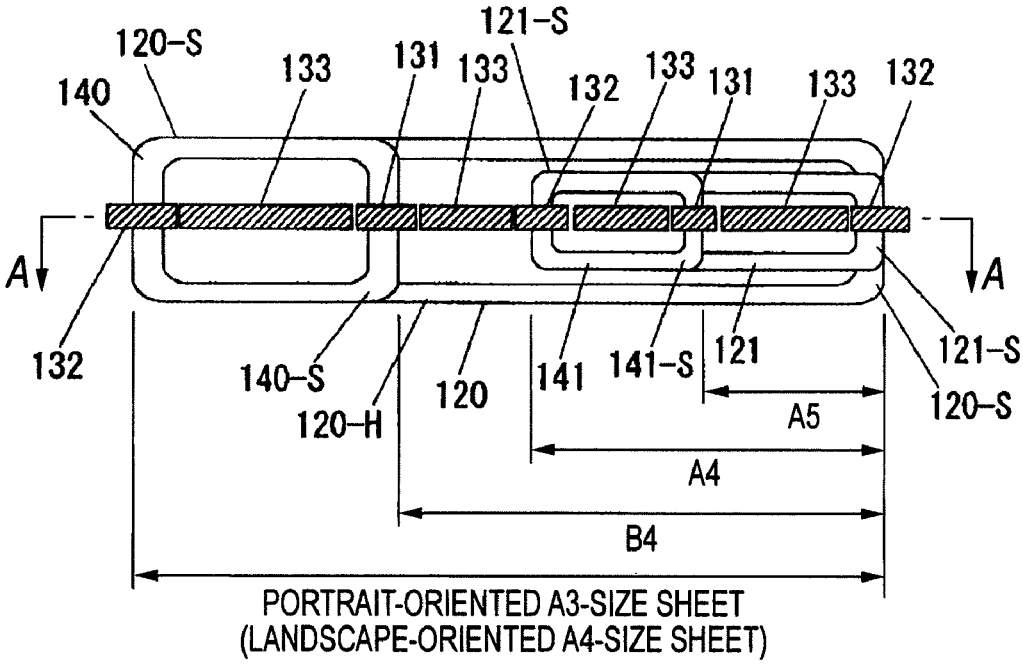
FIG. 9A is a top view of a layout of a coil unit making up the induction heater of a second embodiment of the present invention.
Figure 9B:
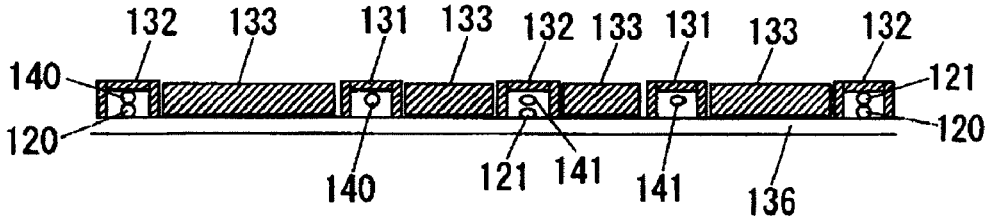
FIG. 9B is a cross sectional view of the layout of the coil unit making up the induction heater of the second embodiment of the present invention taken along line A-A shown in FIG. 9A.

FIG. 9A is a top view of a layout of a coil unit making up the induction heater of the second embodiment of the present invention. FIG. 9B is a cross sectional view of the layout of the coil unit making up the induction heater of the second embodiment of the present invention taken along line A-A shown in FIG. 9A. In FIG. 9, reference numeral 120 designates a first exciting coil of the second embodiment. The first exciting coil 120 is wound so as to assume a substantially-rectangular shape parallel to both longitudinal and lateral directions of the heating roller 10 and connected to the d.c. power source as in the case of the first embodiment (see FIG. 7). Reference numeral 121 designates a second exciting coil which is situated on an inner periphery side of the first exciting coil 120; which is wound in such a way that one side overlaps the first exciting coil and four sides become parallel to the first exciting coil; and which is smaller than the first exciting coil 120. The second exciting coil 121 is also connected to the power source. The first exciting coil 120 and the second exciting coil 121 are litz wires as in the case with the first embodiment. The first exciting coil 120 and the second exciting coil 121 correspond to the first exciting coil 20 and the second exciting coil 21 of the first embodiment, respectively.

The second exciting coil 121 of the second embodiment is of a single-side reference heating type in which one side of a recording sheet is taken as a reference during fixing operation. As shown in FIGS. 9A and 9B, a turn portion 120-S of the first exciting coil 120 and a turn portion 121-S of the second exciting coil 121 are positioned too far to one side (i.e., the right end side in FIG. 9), and the turn portions are stacked into a two-tier form at the right end. The first exciting coil 120 heats a recording sheet having the largest width; namely, an A3-size recording sheet in the embodiment. The first exciting coil 120 has an axial width of the A3-size recording sheet. The second exciting coil 121 is commensurate with the third largest width of a recording sheet; namely, an A4-size recording sheet. The second exciting coil 121 has the same axial width as that of the third largest width of the recording sheet.

When a d.c. current is fed to the first exciting coil 120 and the second exciting coil 121 from the power source, the respective coils make up LC resonance circuits along with resonance capacitors as in the case with the first embodiment. Alternating magnetic fields develop around the first exciting coil 120 and the second exciting coil 121. A control circuit (not shown) controls a duty ratio at this time. Magnetic fluxes commensurate with amounts of electric current are thereby produced. Either the first exciting coil 120 or the second exciting coil 121 is selected when the induction heater is in operation, and power is fed to the thus-selected exciting coil.

The turn portion 140-S (on the left end side) of the first degaussing coil 140 is stacked on the turn portion 120-S located on one-end side of the first exciting coil 120 (the left end side in FIG. 9) in a two-tier form. A turn portion 141-S (on the left end side) of the second degaussing coil 141 is stacked on the turn portion 121-S located on one-end side (also on the left end side) of the second exciting coil 121 in a two-tier form. The first degaussing coil 140 and the second degaussing coil 141 are intended for canceling some of the magnetic fluxes developing from the first exciting coil 120 and the second exciting coil 121, thereby subjecting magnetic fluxes of a predetermined width to interlinkage with the heating roller main body 10*a* (which is analogous to that described in connection with the first embodiment, and reference is made to FIG. 2). The first degaussing coil 140 and the second degaussing coil 141 correspond to the first degaussing coil 40*a* and the second degaussing coil 41*a* of the first embodiment.

The first degaussing coil 140 is a degaussing coil that cancels magnetic fluxes in order to heat a recording sheet that is shorter than the first exciting coil 120 and that has the second largest size. For instance, when an A3-size recording sheet is subjected to fixing, fixing is carried out by use of the first exciting coil 120. However, when a B4-size recording sheet is subjected to fixing, electric power is applied to the first exciting coil 120 and the first degaussing coil 140. Some of magnetic fluxes developing from the first exciting coil 120 are canceled by magnetic fluxes developing from the first degaussing coil 140, thereby performing fixing. Likewise, when the A4-size recording sheet is subjected to fixing, fixing is carried out by means of the second exciting coil 121. When the A5-size recording sheet is subjected to fixing, electric power is fed to both the second exciting coil 121 and the second degaussing coil 141, whereby some of magnetic fluxes developing from the second exciting coil 121 are canceled by magnetic fluxes developing from the degaussing coil, to thus effect fixing over an area of an A5-size.

In FIGS. 9A and 9B, the second axial direction cores 132 are cores that straddle two coils at three locations. Specifically, the second axial direction cores 132 are provided so as to straddle two turn portions at three locations (1), (2), and (3); namely, (1) an overlap between the turn portion 120-S of the first exciting coil 120 and the turn portion 140-S of the first degaussing coil 140; (2) an overlap between the turn portion 121-S of the second exciting coil 121 and the turn portion 141-S of the second degaussing coil 141; and (3) an overlap between the turn portion 120-S of the first exciting coil 120 and the turn portion 121-S of the second exciting coil 121.

The first axial direction core 131 is a core that straddles one coil at two locations. Namely, the first axial direction core 131 is provided so as to straddle one turn portion at (1) the turn portion 140-S of the first degaussing coil 140 and (2) the turn portion 141-S of the second degaussing coil 141. The third axial direction cores 133 are scattered in a line at predetermined intervals at which the first axial direction cores 131 and the second axial direction cores 132 can be magnetically coupled together. The conveyance direction cores (not shown) are disposed so as to cross the cores at right angles as in the first embodiment. The first axial direction cores 131, the second axial direction cores 132, and the third axial direction cores 133 correspond to the first axial direction cores 31, the second axial direction cores 32, and the third axial direction cores 33 of the first embodiment. These actions are the same as those described in connection with the first embodiment.

When electric power is applied to the first exciting coils 120, the magnetic fluxes generated by the first exciting coils 120 are guided through the interiors of the first axial direction cores 131, the second axial direction cores 132, and the third axial direction cores 133, to thus undergo interlinkage with the heating roller main body 10*a* and make up a magnetic circuit. The heating roller main body 10*a* by means of the eddy current. The A3-size recording sheet can thereby undergo fixing.

When an alternating current is applied to the first exciting coil 120 and further to the first degaussing coil 140 in this state, resultant magnetic fluxes are guided through the first axial direction cores 131, the second axial direction cores 132, and the third axial direction cores 133, to thus undergo interlinkage with the heating roller main body 10*a* and make up a magnetic circuit as shown in FIG. 6. The magnetic fluxes of the first exciting coil 120 and the magnetic fluxes of the first degaussing coil 140 cancel each other in the second axial direction cores 132 and the third axial direction cores 133. However, the magnetic fluxes developing from the turn portion 140-S (the right turn portion) of the first degaussing coil 140 are not canceled and still remain. The magnetic fluxes are guided through the interior of the first axial direction cores 131, to thus undergo interlinkage with the heating roller main body 10*a* and heat the heating roller main body 10*a*.

Specifically, one of the turn portions 140-S of the first degaussing coil 140 contributes to heating operation of the heating roller 10. Thus, use of the first degaussing coil 140 makes it possible to perform heating operation as well as degaussing operation. Thus, it is possible to fix a recording sheet having an axial width of a B4-size that is shorter than the length of the first exciting coil 120 by an amount corresponding to the length of the first degaussing coil 140.

The control circuit that drives the coil unit of the induction heater of the second embodiment is analogous to that described in connection with the first embodiment. Hence, the descriptions provided in connection with the first embodiment are quoted, and its repeated detailed descriptions are omitted here. Specifically, in FIG. 7, the first exciting coil 120 is placed in lieu of the first exciting coil 20, and the second exciting coil 121 is disposed in lieu of the second exciting coil 21. Moreover, a first degaussing coil 140 is disposed in place of the first degaussing coils 40*a* and 40*b*. A second degaussing coil 141 is placed in lieu of the second degaussing coils 41*a* and 41*b*. Put another way, the coil unit is configured such that the first degaussing coil 40*a* is replaced, except the first degaussing coil 40*b* and the second degaussing coil 41*b* shown in FIG. 7, with the first degaussing coil 140 and that the second degaussing coil 41*a* is replaced with the second degaussing coil 141. Accordingly, the first degaussing coil 40*a* and the second degaussing coil 41*a* each are provided with one relay contact point (the relay contact point of the first degaussing coil 40*a* and the relay contact point of the second degaussing coil 41*a*) in place of the relay contact points 62*a* and 62*b* and the relay contact points 63*a* and 63*b* shown in FIG. 7. A control circuit equivalent to the control circuit 94 controls the relay circuit, thereby driving the drive circuits equivalent to the drive circuits 80 and 81 and an ON period of a switching element equivalent to the switching elements 70 and 71. Duty control is thereby performed. Details of operation are analogous to details of its counterpart operation described in connection with the first embodiment except that the first and second degaussing coils and the relay contact points used for short-circuiting the degaussing coils are reduced to one degaussing coil and one relay contact point.

Explanations are now given to a case where a small recording sheet is subjected to fixing by use of the second exciting coil 121. When electric power is applied to the second exciting coil 121, resultant magnetic fluxes are guided through the interiors of the first axial direction cores 131, the second axial direction cores 132, and the third axial direction cores 133. The magnetic fluxes then undergo interlinkage with the heating roller main body 10*a*, thereby generating an eddy current. An A4-size recording sheet having the same axial length as that of the second exciting coil 121 can thereby be subjected to fixing.

Subsequently, when an a.c. current is applied further to the second degaussing coil 141, the magnetic fluxes developing from the second degaussing coil 141 are guided through the first axial direction cores 131, the second axial direction cores 132, and the third axial direction cores 133, to thus undergo interlinkage with the heating roller main body 10*a*. The magnetic fluxes of the second exciting coil 121 and the magnetic fluxes of the second degaussing coil 141 cancel each other within the magnetic members (see FIG. 6). However, the magnetic fluxes developing from the turn portion 141-S (the right turn portion) of the second degaussing coil 141 remain uncanceled and are guided through the interior of the first axial direction core 131, to thus undergo interlinkage with the heating roller main body 10*a* and heat the heating roller main body 10*a*. The A5-size recording sheet that is shorter than the axial length of the second exciting coil 121 by an amount equal to the axial length of the second degaussing coil 141 can thereby be subjected to fixing.

As mentioned above, the induction heater of the second embodiment of the present invention is equipped with two exciting coils and two degaussing coils. The two exciting coils are stacked into a two-tier form while single sides of the respective coils are overlaid one on top of the other. The two degaussing coils are stacked on the two exciting coils into a two-tier form while three sides of the exciting coils are overlaid on three sides of the degaussing coils one on top of the other. A magnetic member is provided on remaining single sides that are not overlaid. It thus becomes possible to control a heat zone width by means of a reference on one side. The capability to control a temperature rise that will arise during use of degaussing coils is enhanced, and power can be saved when small recording sheets are continually fed. There is adopted a structure in which an exciting coil is separated into the first exciting coil 120 and the second exciting coil 121 instead of use of a single exciting coil; in which the first degaussing coil 140 and the second degaussing coil 141 are stacked on the respective exciting coils; and in which a small heat zone is subjected to heating. Therefore, when compared with a structure in which a single exciting coil is degaussed by means of a plurality of types of degaussing coils, greater power saving can be accomplished during feeding of small recording sheets.

The induction heater of the second embodiment can perform fixing while the number of degaussing coils is reduced to one. Further, an edge on one side of a recording sheet is taken as a reference. The axial length of the heating roller also becomes shorter, and a compact, inexpensive induction heater can be embodied.

(Third Embodiment)

An induction heater of the third embodiment of the present invention also heats the heating roller 10 by taking the center of a recoding sheet as a reference as in the case of the first embodiment. However, the induction heater is not disposed outside the heating roller 10. The induction heater is of a type in which heating is performed by making up a magnetic circuit in the heating roller 10. Since the third embodiment also matches the first embodiment in view of the principal configuration, reference is made to FIGS. 1 through 8 even in connection with the third embodiment. When compared with the reference numerals assigned to the configuration of the first embodiment, reference numerals of the order of two hundreds are basically assigned to the configuration of the third embodiment. For instance, as compared with the first exciting coil 20 of the first embodiment, the first exciting coil of the third embodiment is assigned reference numeral 220.

Figure 10A:
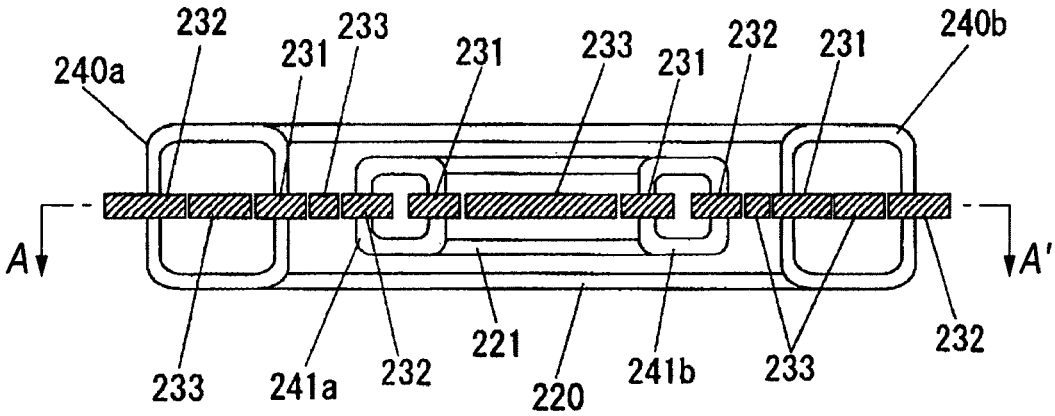
FIG. 10A is a top view of a layout of a coil unit making up the induction heater of a third embodiment of the present invention.
Figure 10B:
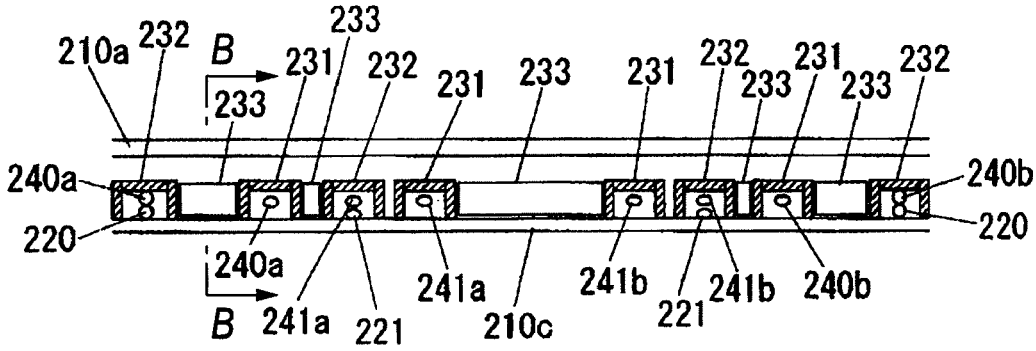
FIG. 10B is a cross sectional view of the layout of the coil unit making up the induction heater of the third embodiment of the present invention taken along line A-A$^1$ shown in FIG. 10A.
Figure 11:
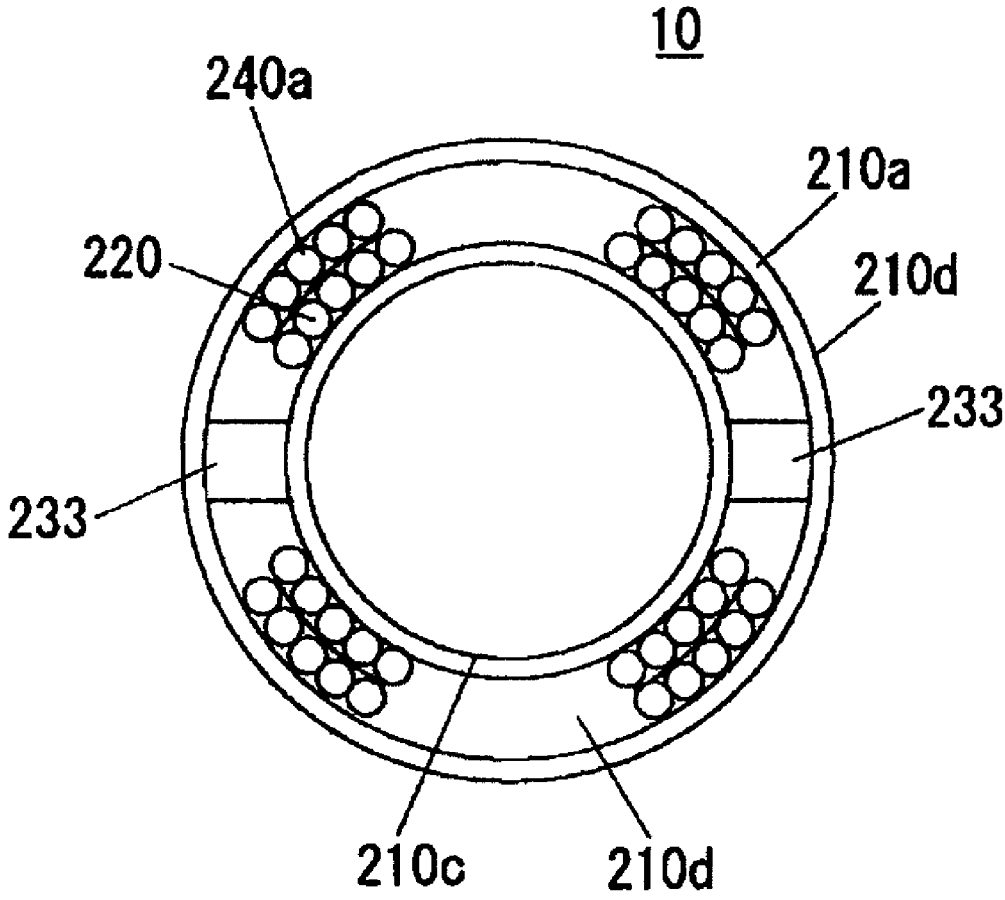
FIG. 11 is a cross sectional view of a heating roller in which the induction heater of the third embodiment of the present invention is disposed taken along line B-B shown in FIG. 10B.

FIG. 10A is a top view of a layout of a coil unit making up the induction heater of the third embodiment of the present invention; FIG. 10B is a cross sectional view of the layout of the coil unit making up the induction heater of the third embodiment of the present invention taken along line A-A$^1$ shown in FIG. 10A; and FIG. 11 is a cross sectional view of a heating roller in which the induction heater of the third embodiment of the present invention is disposed taken along line B-B shown in FIG. 10B. In FIGS. 10A and 10B, reference numeral 220 designates a first exciting coil of the third embodiment that is wound so as to assume a substantially-rectangular shape in parallel with the longitudinal direction and the lateral direction of the heating roller 10. Reference numeral 221 designates a second exciting coil wound in such a way that the coil is surrounded in the interior of the first exciting coil 220 and that four sides of the second exciting coil become parallel to the first exciting coil 220. The first exciting coil 220 and the second exciting coil 221 correspond to the first exciting coil 20 and the second exciting coil 21 of the first embodiment.

Two degaussing coils (first degaussing coils 240*a* and 240*b*) are stacked on respective longitudinal ends of the first exciting coil 220 in a two-tier form. Further, two degaussing coils (second degaussing coils 241*a* and 241*b*) are stacked on respective ends of the second exciting coil 221 surrounded by the first exciting coil 220 in a two-tier form. These four degaussing coils are for cancelling some of the magnetic fluxes of the first exciting coil 220 and the magnetic fluxes of the second exciting coil 221. The first degaussing coils 240*a* and 240*b* and the second degaussing coils 241*a* and 241*b* correspond to the first degaussing coils 40*a* and 40*b* and the second degaussing coils 41*a* and 41*b* of the first embodiment. They are identical to each other even in terms of operation.

Next, in FIGS. 10A, 10B, and 11, reference numeral 231 designates first axial direction cores placed, while oriented in the axial direction of the heating roller 10, so as to straddle single sides of the respective first degaussing coils 240*a* and 240*b*. Reference numeral 232 designates second axial direction cores disposed, while oriented in the axial direction of the heating roller 10, so as to straddle two coils among respective combinations consisting of the first exciting coil 220 and the first degaussing coils 240*a* and 240*b*. Reference numeral 233 designates a third axial direction core of the third embodiment. The first axial direction cores 231 and the second axial direction cores 232 are for guiding magnetic fluxes of the first exciting coil 220 and magnetic fluxes of the second exciting coil 221 and for making up an intensive magnetic circuit between the heating roller main body 210*a* (see FIG. 11) and the first and second axial direction cores. The first axial direction cores 231, the second axial direction cores 232, and the third axial direction cores 233 correspond to the first axial direction cores 31, the second axial direction cores 32, and the third axial direction cores 33 of the first embodiment.

Conveyance direction cores (not shown), the first axial direction cores 231, the second axial direction cores 232, and the third axial direction cores 233 of the third embodiment also exhibit the same operations as those described in connection with the first embodiment. These direction cores are made of a magnetic material and for confining magnetic fluxes developing from the respective coils within magnetic members, to thus prevent leakage of the magnetic fluxes outside. Thus, flow of magnetic fluxes of high flux density is produced. The majority of the magnetic fluxes developing from the coils are guided through the interiors of the magnetic members, to thus undergo interlinkage with the heating roller main body 210*a*. An eddy current originates from the magnetic fluxes within the interior of the heating roller main body 210*a*, thereby heating the heating roller 10.

In FIGS. 10B and 11, reference numeral 210*c* designates a cored bar of the heating roller 10. The cored bar 210*c* has a cylindrical surface concentric with the heating roller main body 210*a*. The first exciting coil 220, the first degaussing coils 240*a*, 240*b*, the second exciting coil 221, and the second degaussing coils 241*a*, 241*b* are interposed in space between the cored bar 210*c* and the heating roller main body 210*a*. The space between the cored bar 210*c* and the heating roller main body 210*a* is filled with an elastic layer 210*d* using silicon rubber. The axial configuration of the heating roller 10 is completely identical with that of the coil unit described in connection with the first embodiment. A drive circuit is also totally identical with that described in connection with the first embodiment. Therefore, the descriptions about the first embodiment are also common to the third embodiment. Hence, the descriptions provided in connection with the first embodiment are quoted, and its repeated detailed descriptions are omitted here.

As mentioned above, the induction heater of the third embodiment utilizes the internal space of the heating roller 10 that is not utilized in the first embodiment, and two exciting coils and four degaussing coils are provided as in the first embodiment. Two degaussing coils are stacked on each of the exciting coil such that three sides of each of the degaussing coils are overlaid on the exciting coil in a two-tier form. A magnetic member is provided so as to straddle one remaining side that is not superimposed on the exciting coil. The capability to control a temperature increase in a non-sheet-feeding area of the induction heater 16 can thereby be enhanced, and electric power, which has hitherto been dissipated by heat that travels to the circumferences during continual feeding of small recording sheets, can be curtailed.

The induction heater is provided in the heating roller 10 rather than on the outside of the heating roller 10, and heating is performed. Therefore, the induction heater and the fixing unit become compact, thereby making it possible to miniaturize an image forming apparatus.

This application is based upon and claims the benefit of priority of Japanese Patent Application No 2009-222235 filed on 2009 Sep. 28, the contents of which are incorporated herein by reference in its entirety.

What is claimed is:

1. An induction heater, comprising:

a cylindrical heating roller that performs electromagnetic induction heating;

an exciting coil that heats the heating roller;

a degaussing coil that is made so as to become shorter than the exciting coil in an axial direction of the heating roller and that decreases magnetic fields of the exciting coil; and magnetic members that are made of a magnetic material and that guide magnetic fluxes of the exciting coil and/or magnetic fluxes of the degaussing coil, thereby making up a magnetic circuit between the magnetic members and the heating roller, wherein the exciting coil has parallel portions extending in parallel with the axial direction of the heating roller and two turn portions provided at both ends of the parallel portions;

the degaussing coil has parallel portions extending in parallel with the axial direction of the heating roller and two turn portions provided at both ends of the parallel portions;

the exciting coil and the degaussing coil include a common structure that is adapted to overlay one of the two turn portions and the parallel portions of the exciting coil on one of the two turn portions and the parallel portions of the degaussing coil; and the magnetic members comprise a plate-like conveyance-direction-oriented core aligned along a circumferential direction orthogonal to the axial direction of the heating roller so as to straddle the longitudinal direction of the exciting coil, and a plate-like axial direction core aligned to the axial direction of the heating roller and placed in a direction orthogonal to the plate-like conveyance-direction-oriented core so as to straddle only a lateral portion of the degaussing coil at an other one of the two turn portions.

2. The induction heater according to claim 1, wherein at least one of the magnetic members assumes a substantially C-shaped geometry, and both ends of the at least one of the magnetic members are provided in close proximity to the heating roller.

3. The induction heater according to claim 1, wherein at least one of the magnetic members made of a magnetic material is continually placed in an interior of the parallel portions of the exciting coil, along the parallel portions, and at intervals at which magnetic members are magnetically coupled together.

4. The induction heater according to claim 1, wherein magnetic members that are made of a magnetic material and that guide magnetic fluxes of the exciting coil and the degaussing coil make up a magnetic circuit between the heating roller and the magnetic members.

5. The induction heater according to claim 1, wherein the degaussing coil includes two degaussing coils, and the two degaussing coils are disposed at both ends of the exciting coil in the axial direction of the heating roller.

6. The induction heater according to claim 1, wherein the exciting coil and the degaussing coil are disposed on an outside of the heating roller.

7. The induction heater according to claim 1, wherein the exciting coil and the degaussing coil are provided in the heating roller.

* * * * *